United States Patent [19]

Gandy et al.

[11] Patent Number: 5,067,936

[45] Date of Patent: Nov. 26, 1991

[54] METHOD FOR MANUFACTURING A YARN CARRIER

[75] Inventors: Carroll E. Gandy; Roland S. Watford, Jr., both of Darlington, S.C.

[73] Assignee: Sonoco Products Company, Hartsville, S.C.

[21] Appl. No.: 658,191

[22] Filed: Feb. 20, 1991

Related U.S. Application Data

[62] Division of Ser. No. 498,987, Mar. 26, 1990, Pat. No. 5,014,928.

[51] Int. Cl.[5] ..... B31C 7/02; B31C 11/02

[52] U.S. Cl. ..... 493/287; 493/290; 493/296; 51/125

[58] Field of Search ..... 493/287, 288, 290, 296, 493/340; 51/54, 125, 227 R

[56] References Cited

U.S. PATENT DOCUMENTS

| | | | |
|---|---|---|---|
| 1,946,198 | 2/1934 | Dunlap | 493/291 |
| 3,464,327 | 7/1969 | Yovanovich | 493/291 |
| 3,610,117 | 10/1971 | Nash | 493/288 |
| 4,671,784 | 6/1987 | Duch | 493/29 |
| 4,700,834 | 10/1987 | Martinez | 206/388 |
| 4,700,904 | 10/1987 | Martinez | 242/18 R |

FOREIGN PATENT DOCUMENTS

| | | | |
|---|---|---|---|
| 359935 | 10/1931 | United Kingdom | 493/291 |
| 492680 | 9/1938 | United Kingdom | 493/291 |

*Primary Examiner*—William E. Terrell

*Attorney, Agent, or Firm*—Bell, Seltzer, Park & Gibson

[57] ABSTRACT

A method of manufacturing a yarn carrier designed to accommodate the tail of the yarn to be wound therearound without severing. A tube is wound from paper and a portion severed therefrom, producing a burr. A subsequent grinding operation removes the burr, and forms a beveled region having loose fibers to cushion the yarn against a winding mandrel.

2 Claims, 2 Drawing Sheets

METHOD FOR MANUFACTURING A YARN CARRIER

This application is a division of application Ser. No. 498,987, filed Mar. 26, 1990. U.S. Pat. No. 5,014,928

BACKGROUND OF THE INVENTION

The present invention relates to a yarn carrier, and a method and apparatus for manufacturing the same, and wherein the carrier is characterized by the ability to accommodate the tail of the yarn to be wound thereon between the carrier and the base plate of the winding machine, without severing the yarn tail during winding of the package.

Yarn carriers of the described type are designed to be wound with a yarn, and with a yarn tail extending from the carrier to permit the trailing end of the yarn on an exhausted carrier to be tied to the leading end of the yarn on a succeeding fully wound carrier. The yarn tail is typically formed at the beginning of the yarn winding operation by taking a length of yarn and extending it over the open large end of the carrier. The carrier is then mounted into a cradle of the winding machine which includes a base plate which fits into the large end of the cone and holds the yarn tail. A nose plate secures the small end of the carrier for proper rotation about a fixed axis in the machine, and the carrier is rotated by a rotating drum which engages the surface of the carrier and which feeds the yarn onto the rotating carrier in a predetermined reciprocating pattern.

Such yarn carriers are commonly manufactured from a sheet of paper which is wound about a mandrel to form a frusto-conical tubular member composed of several layers of the paper sheet. Both ends of the resulting tubular member are trimmed during the winding operation to provide even end surfaces, and the carrier is then finished to provide a rounded nose at the small end. The above end trimming operation is conventionally effected by a knife blade which moves radially inwardly against the paper sheet as it is being wound, and this operation inherently produces a rather sharp, annular burr at the intersection of the inner wall surface and the cut end surface at the large end of the tubular member. The annular burr at the large end is undesirable, in that it acts to sever the yarn tail when the yarn tail is positioned between the large end of the carrier and the base plate of a winding machine in accordance with the above described winding procedure. More particularly, the carrier often rotates relative to the base plate during the starting and stopping of the winding operation, and this relative movement causes the annular burr to sever the yarn tail.

To alleviate the severance problem, it has been proposed to polish the inside wall at the large end of the tubular member, to eliminate the burr. More particularly, this prior polishing operation has been performed with the use of a chuck having a profile matching the desired profile of the large end of the carrier, and it resulted in a slightly beveled edge on the inside of the large end of the carrier, and with the paper material at the large end being compressed to form a relatively hard inner surface.

While the polishing of the inner end of the carrier has been a generally satisfactory method of removing the sharp annular burr and thereby avoiding the severance of the yarn tail during the winding process, modern winding machines have been designed with a universal base plate which is adapted to receive carriers of various angles of taper, to thereby avoid the expense of changing base plates whenever a different style of carrier is being wound. While such universal base plates are efficient from this point of view, they create a further problem in that the yarn tail is often pinched by a non-flush fit between the inside end surface of the carrier and the base plate, and such pinching in turn often results in the severance of the yarn tail. This problem is particularly acute where the carrier includes a hardened inner end surface as described above, since the hardened nature of the inner end surface tends to aggravate the severity of the pinching problem.

Other solutions for the problem of severing the yarn tail have been proposed, note for example, U.S. Pat. Nos. 4,700,834 and 4,700,904, both issued to Martinez. These prior patents suggest the formation of spaced apart grooves, or grooves of crisscross configuration, or forming a ring of loose non-woven fibrous material of substantial thickness on the inside surface of the large end of the carrier. However, these rather elaborate constructions do not address the problem associated with the sharp annular burr as discussed above.

It is accordingly an object of the present invention to provide a yarn carrier, and a method and apparatus for manufacturing the same, which effectively avoids the above noted problem of severance of the yarn tail during the winding operation.

SUMMARY OF THE INVENTION

The above and other objects and advantages of the present invention are achieved by the discovery of a novel manufacturing process for removing the sharp annular burr formed during the end cutting operation, and which not only removes the burr, but also avoids the formation of a hardened inner surface at the large end of the carrier, and which instead provides a soft, non-biting surface which has been found to avoid pinching engagement and severance of the yarn tail during the winding operation.

More particularly, the present invention involves the method and apparatus for manufacturing a yarn carrier and which includes the steps of winding a fibrous sheet of paper into a tubular shape and so as to form a tubular member which defines a central axis, and parallel inner and outer wall surfaces. The tubular member is severed adjacent at least one end thereof by moving a knife blade radially inwardly with respect to the resulting tubular member, and so as to produce a cut end which lies in a plane which is substantially perpendicular to the central axis. Also, a relatively sharp annular burr is formed at the intersection of the cut end and the inner wall surface. To remove the burr, an abrasive grinding wheel is provided which has a forward end which includes an annular grinding surface. The tubular member is aligned with the forward end of the grinding wheel and such that the annular burr is in contact with the annular grinding surface, and the grinding wheel and the tubular member are then relatively rotated about the central axis to thereby grind and remove the annular burr and produce a relatively soft ground annular surface segment composed of loosened fibers and which is positioned between the inner wall surface and the cut end surface.

In the preferred embodiment, the annular grinding surface is of generally frusto-conical configuration and is sized so as to be at least partially received in the cut end of the tubular member, and such that the annular grinding surface faces radially outwardly so as to directly engage and remove the annular burr during the grinding operation.

The resulting yarn carrier preferably comprises a tubular body member composed of several wound layers of paper. Also, the action of the grinding wheel serves to bevel the end of at least the innermost layer of paper, so that the beveled end is composed of loosened paper fibers which form the relatively soft ground surface segment, and the beveled end is preferably configured so that no portion thereof lies radially inside of a projection of the inner wall surface of the tubular member.

BRIEF DESCRIPTION OF THE DRAWINGS

Some of the objects and advantages of the present invention having been stated, others will appear as the description proceeds, when taken in conjunction with the accompanying drawings, in which.

DETAILED DESCRIPTION OF THE PREFERRED EMBODIMENTS

Figure 1:
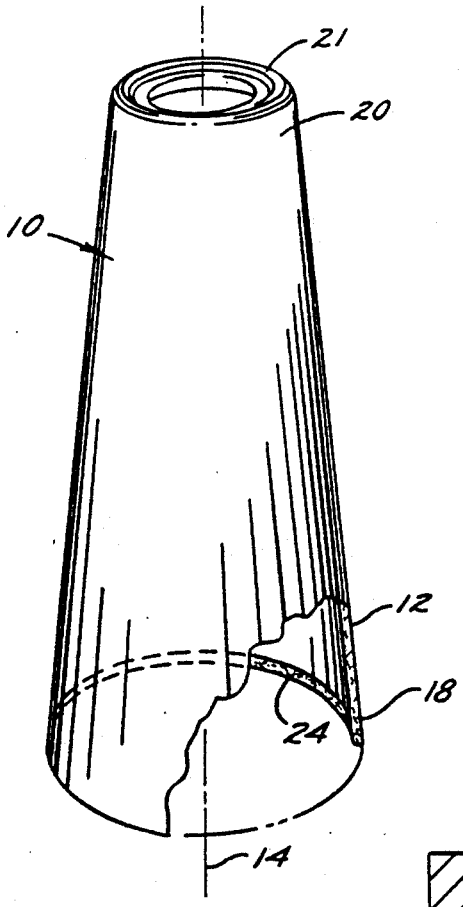
FIG. 1 is a partly sectioned, perspective view of a yarn carrier which embodies the features of the present invention.
Figure 2:
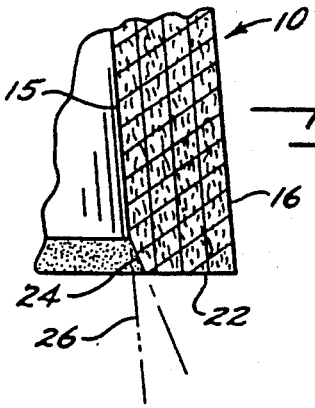
FIG. 2 is a fragmentary and enlarged sectional view of the large end of the yarn carrier.
Figure 3:
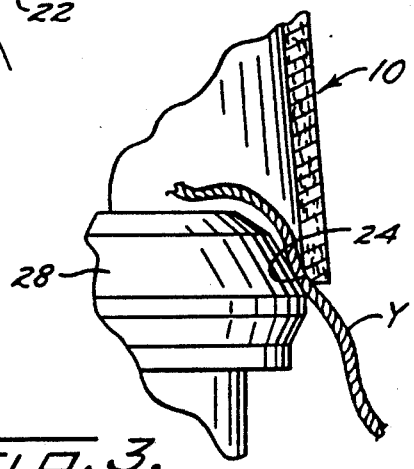
FIG. 3 is a fragmentary view illustrating the yarn carrier mounted on the base plate of a winding machine and with the yarn tail being held between the carrier and base plate.

Referring initially to FIGS. 1-3, a preferred embodiment of a yarn carrier in accordance with the present invention is indicated generally at 10. The carrier 10 comprises a tubular body member 12 of generally frusto-conical configuration, and which is composed of four wound layers of paper in the illustrated embodiment. The body member defines a central axis 14, parallel inner and outer wall surfaces 15, 16, a base end portion 18, and an opposite end portion 20. The opposite end portion 20 is formed into a rounded nose 21 of conventional configuration, and the base end portion includes a generally flat end surface 22 which is disposed in a plane lying generally perpendicular to the central axis 14. Further, the base end portion 18 includes an annular surface segment 24 disposed between the inner wall surface 15 and the end surface 22 and which faces radially inwardly. The annular surface segment 24 comprises a beveled end of the innermost layer of paper as best seen in FIG. 2, and it is composed of loosened paper fibers as further described below, and so that it is relatively soft. Further, the annular surface segment 24 is configured so that no portion thereof lies radially inside of a projection 26 of the inner wall surface, and in the illustrated embodiment, the segment 24 lies entirely outside the projection 26.

During the winding of a yarn upon the carrier 10, the yarn tail Y is positioned between the base plate 28 of the winding machine and the base end portion 18 of the carrier as seen in FIG. 3. More particularly, the yarn tail Y is supported and held between the base plate 28 and the relatively soft annular surface segment 24, and the soft nature and positioning of the segment 24 have been found to avoid pinching engagement and severance of the yarn tail during the winding process.

The above described yarn carrier 10 may be efficiently manufactured by a method and apparatus as schematically illustrated in FIGS. 4-7 . The apparatus includes a conventional cone winding machine 30, wherein sheets of fibrous paper are serially wound on a tapered mandrel to form conical tubular members 33. Also, during the winding operation, a pair of rotary knife blades cut the resulting tubular members to proper length, with the blades cutting radially inwardly with respect to the tubular member. The rotary knife blade which is associated with the ends 36 of the members 33, is schematically illustrated at 34 in FIG. 5. As a result of this trimming operation, two cut ends 36, 37 are produced, each lying in a plane which is substantially perpendicular to the central axis. As also schematically illustrated in FIG. 5, the fact that the rotating knife blades move radially inwardly with respect to the wound tubular member, results in the formation of a relatively sharp annular burr 38 at the intersection of each cut end 36, 37 and the inner wall surface 15 of the tubular member.

Figure 7:
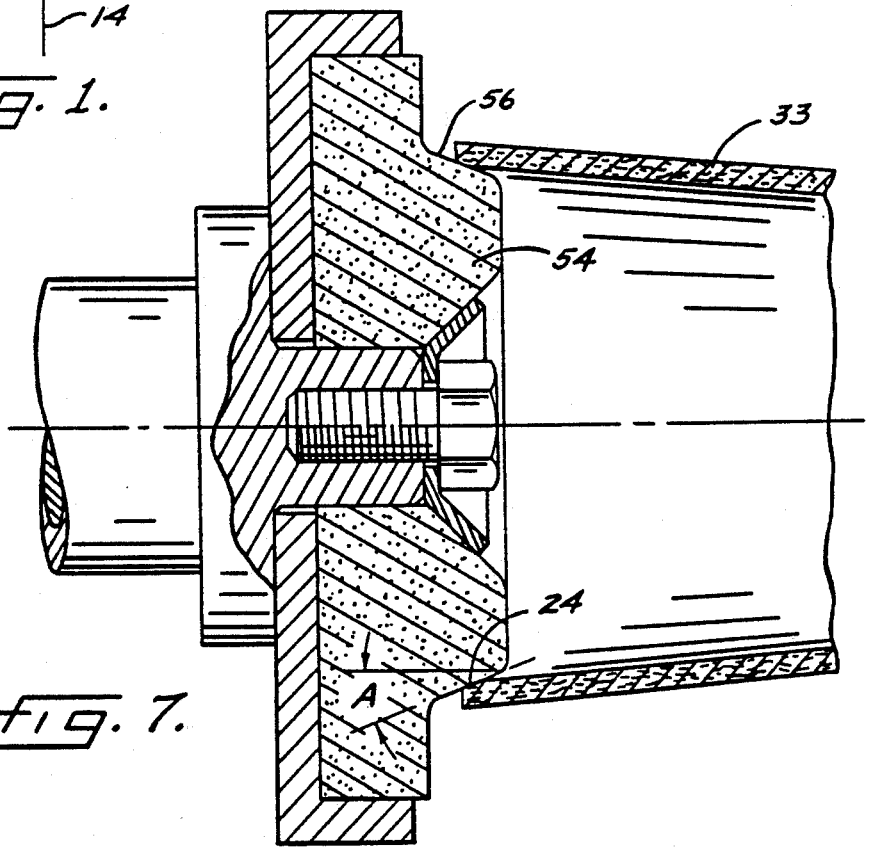
FIG. 7 is a fragmentary sectional view of the step of grinding the large end of the tubular member.
Figure 4:
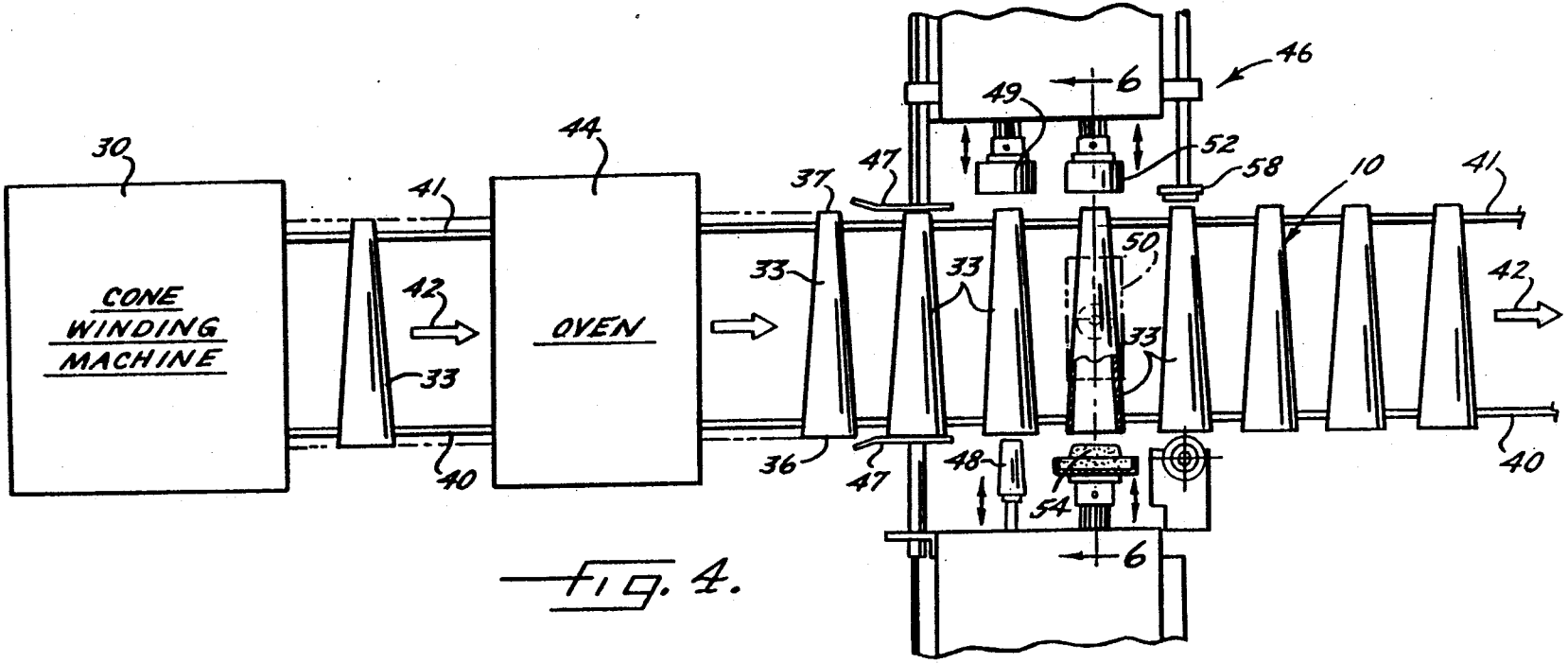
FIG. 4 is a schematic plan view of the process and apparatus for manufacturing the yarn carrier in accordance with the present invention.
Figure 6:
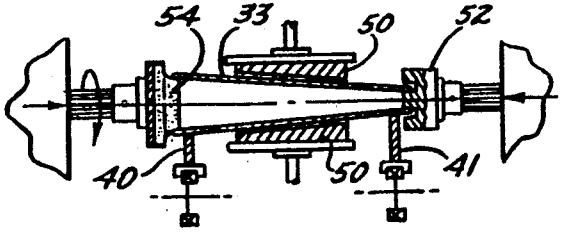
FIG. 6 is a fragmentary sectional view taken substantially along the line 6—6 of FIG. 4.
Figure 5:
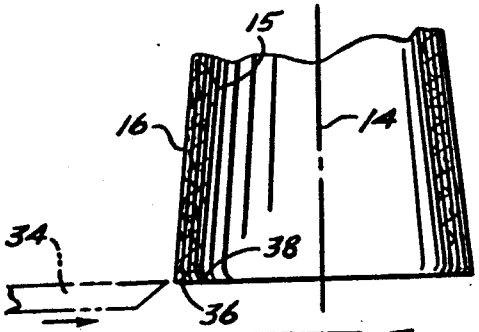
FIG. 5 is a fragmentary sectional view illustrating the step of severing the large end of the wound tubular member.

In the illustrated embodiment, the wound tubular members 33 are then conveyed incrementally between work stations positioned along a path of travel defined by a pair of parallel conveyors 40, 41 and in the direction indicated by the arrows 42. The tubular members 33 are first conveyed through a conventional drying oven 44, and then to a finishing machine 46. At the initial station of the finishing machine, the tubular members 33 are axially positioned on the conveyors by the guide plates 47, and a lubricant may be applied to the small or nose end 37 of each tubular member in a conventional manner. At a second station, a point 48 is inserted axially into the tubular member, and a rotating chuck 49 then moves forwardly into contact with the nose portion of the cone to form the in-turned nose 21. At the next station, a pair of grippers 50 are moved laterally into contact with the outside surface of the tubular member as best seen in FIG. 6, to prevent its rotation. Also, a back-up chuck 52 is advanced to engage the nose portion of the cone, and a grinding wheel 54, which is coaxially aligned with the central axis of the tubular member at this work station, is axially advanced to engage the large cut end 36 of the tubular member. More particularly, the grinding wheel 54 is composed of an abrasive material having an abrasive grain size of about 16 grit. Also, the grinding wheel 54 has an end surface which includes an annular grinding surface 56 which is of generally frusto-conical configuration, and which is disposed at an angle A of about 15° with respect to the rotational axis of the wheel 54. The annular grinding surface 56 is sized so as to be partially received in the adjacent large end portion 18 of the tubular member as seen in FIG. 7. Thus the grinding surface 56 faces radially outwardly so as to directly engage the annular burr 38.

The grinding wheel 54 is rotated about, its rotational axis, which is coaxial with the central axis of the tubular member, to thereby grind and remove the annular burr 38 and produce the above described relatively soft ground annular surface segment 24 which is composed of loosened paper fibers. A sufficient portion of the annular burr and the adjacent portion of the tubular member is thereby removed so that no portion of the resulting soft ground annular surface segment lies radially inside the projection 26 of the inner wall surface 15, and in a preferred embodiment, the annular surface segment 24 lies totally outside of the projection 26 of the inner wall surface.

From the grinding work station, the tubular members 33 may be conveyed to another downstream work station 58 wherein conventional scoring or notching operations may be performed, if desired.

In the drawings and specification, there has been set forth a preferred embodiment of the invention, and although specific terms are employed, they are used in a generic and descriptive sense only and not for purposes of limitation.

That which is claimed is:

1. A method of manufacturing a yarn carrier of the type which is adapted to be mounted on a winding machine and have a yarn wound thereon to form a yarn package, and comprising the steps of winding a fibrous sheet of paper so as to form a tubular member which defines a central axis, and parallel inner and outer wall surfaces, severing the tubular member adjacent at least one end thereof and including moving a knife blade radially inwardly with respect to the resulting tubular member, and so as to produce a cut end surface which lies in a plane which is substantially perpendicular to said central axis and a relatively sharp annular burr at the intersection of said cut end surface and said inner wall surface, providing an abrasive grinding wheel having an annular grinding surface, aligning said one cut end of said tubular member with said annular grinding surface of said grinding wheel and such that said annular burr is in contact with said annular grinding surface, and relatively rotating said grinding wheel and said tubular member about said central axis while grinding and removing the annular burr to form a beveled end of relatively soft loosened fibers of noncompressed paper, and with the beveled end being at a predetermined angle relative to the central axis of the tubular body so that substantially all of the loosened fibers lie in a plane radially outside a projection of the inner wall surface.

2. A method of manufacturing a yarn carrier of the type which is adapted to be mounted on a winding machine and have a yarn wound thereon to form a yarn package, and comprising the steps of· winding a fibrous sheet of paper so as to form a conical tubular member which defines a central axis, and parallel inner and outer wall surfaces, severing the tubular member adjacent at least the large end thereof and including moving a knife blade radially inwardly with respect to the resulting tubular member and so as to produce a cut end surface adjacent the large end of the tubular member and which lies in a plane which is substantially perpendicular to said central axis, and so as to also produce a relatively sharp inwardly directed annular burr at the intersection of said cut end surface and said inner wall surface, providing an abrasive grinding wheel defining a rotational axis and having an annular grinding surface which is coaxial with said rotational axis, coaxially aligning said tubular member with said grinding wheel and such that said annular burr is in contact with said annular grinding surface, and rotating said grinding wheel about said rotational axis while holding said tubular member stationary while grinding and removing the annular burr to form a beveled end of relatively soft loosened fibers of non-compressed paper, and with the beveled end being at a predetermined angle relative to the central axis of the tubular body so that substantially all of the loosened fibers lie in a plane radially outside a projection of the inner wall surface.

* * * * *

UNITED STATES PATENT AND TRADEMARK OFFICE

CERTIFICATE OF CORRECTION

PATENT NO. : 5,067,936

DATED : November 26, 1991

INVENTOR(S) : Carroll E. Gandy and Roland S. Watford, Jr.

It is certified that error appears in the above-identified patent and that said Letters Patent is hereby corrected as shown below:

Title page, item [75], "Darlington" should be -- Hartsville --.

Column 2, after the Abstract, "2 Claims" should be -- 3 Claims --.

Column 6, after line 40, please add Claim 3 as follows:

3. The method as defined in Claim 2 wherein said annular grinding surface of said grinding wheel is of generally frusto-conical configuration and is sized so as to be at least partially received in the large end of said tubular member during said aligning and rotating steps, and such that said annular grinding surface faces radially outwardly so as to directly engage and remove said annular burr during the rotating step.

Signed and Sealed this

Twenty-third Day of March, 1993

*Attest:*

STEPHEN G. KUNIN

*Attesting Officer*

*Acting Commissioner of Patents and Trademarks*